United States Patent [19]

Katz

[11] 4,381,709

[45] May 3, 1983

[54] PRINTING ROLLER WITH REMOVABLE CYLINDER

[76] Inventor: Robert Katz, 78 W. 11th St., New York, N.Y. 10011

[21] Appl. No.: 159,158

[22] Filed: Jun. 13, 1980

[51] Int. Cl.[3] ..... B41F 13/10; B41F 13/20

[52] U.S. Cl. ..... 101/375; 29/113 R

[58] Field of Search ..... 101/375, 376; 29/113 R, 29/117, 129, 116 AD; 242/72 R, 72 B; 279/2 A, 4; 269/48.1; 82/44; 51/373

[56] References Cited

U.S. PATENT DOCUMENTS

| | | | |
|---|---|---|---|
| 2,583,117 | 1/1952 | Piperoux et al. | 29/113 R |
| 2,797,604 | 7/1957 | Atherholt et al. | 279/4 |
| 2,876,961 | 3/1959 | Cole et al. | 279/4 X |
| 2,949,852 | 8/1960 | Schaefer | 29/123 X |
| 3,166,013 | 1/1965 | Wyllie et al. | 29/113 R |
| 3,202,432 | 8/1965 | Cameron | 242/72 X |
| 3,253,323 | 5/1966 | Saueressig | 29/113 |
| 3,378,902 | 4/1968 | Hoexter | 29/156.4 R |
| 3,388,916 | 6/1968 | Winnen et al. | 279/4 |
| 3,535,760 | 10/1970 | James | 29/113 R |
| 3,762,730 | 10/1973 | Cameron | 242/72 B X |
| 3,770,287 | 11/1973 | Weber | 242/72 |
| 4,050,643 | 9/1977 | Secor | 242/72 R |
| 4,135,677 | 1/1979 | Warczak | 242/72 B |
| 4,147,312 | 4/1979 | Secor et al. | 242/72 R |
| 4,150,622 | 4/1979 | Stollenwerk | 29/113 R X |

*Primary Examiner*—J. Reed Fisher

*Attorney, Agent, or Firm*—Abelman, Frayne & Rezac

[57] ABSTRACT

A printing roller is disclosed comprising a three-piece mandrel assembly having a central hollow tubular section and two outer journal sections. Each journal section has hydraulic fluid passageways formed therein and a cylindrical sleeve circumferentially mounted thereon, the inner surface of which is adapted to be pressurized by the hydraulic fluid system. A removable hollow printing cylinder slidably is mounted onto the three piece mandrel and is frictionally held at the outer journal locations through the application of hydraulic pressure upon the cylindrical sleeves mounted upon each journal.

4 Claims, 5 Drawing Figures

FIG. 2
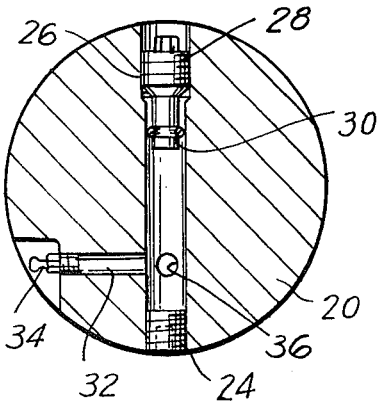
FIG. 3
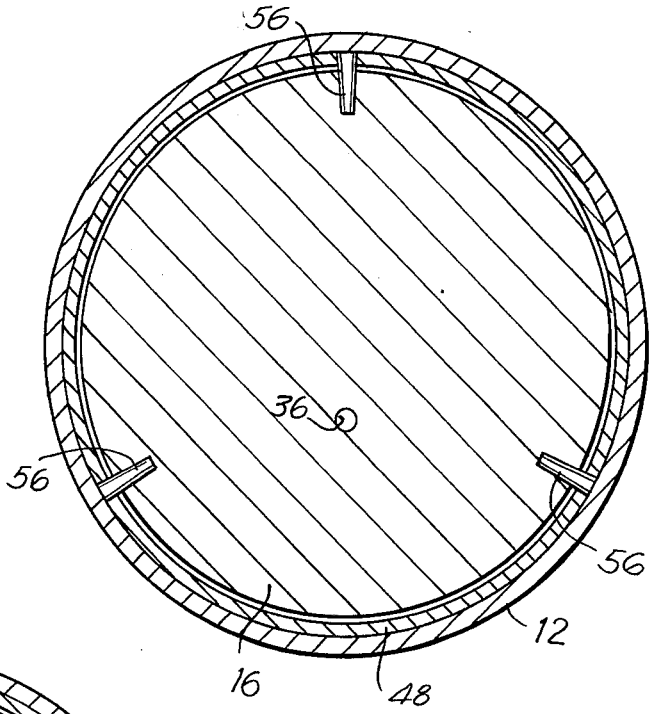
FIG. 4
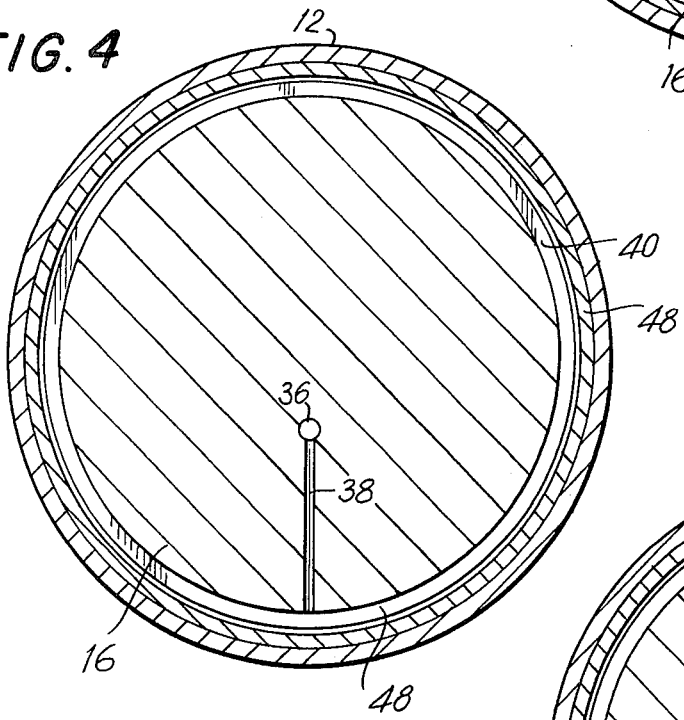
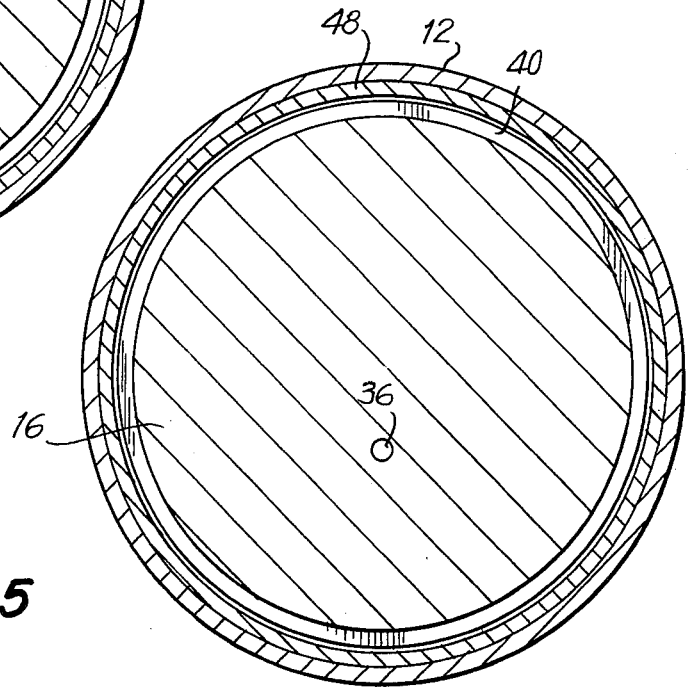
FIG. 5

PRINTING ROLLER WITH REMOVABLE CYLINDER

The subject matter of this patent application is the subject of disclosure document Ser. No. 082,107, filed June 29, 1979 in the U.S. Patent and Trademark Office.

PRIOR ART STATEMENT

A prior art search was conducted with regard to the above-identified invention and the following references were disclosed.

U.S. Pat. No. 4,030,415—Fellows
U.S. Pat. No. 4,150,622—Stollenwork
U.S. Pat. No. 2,987,994—Allison
U.S. Pat. No. 3,378,902—Hoexter
U.S. Pat. No. 4,111,569—Mengel
U.S. Pat. No. 3,791,659—Hardin
U.S. Pat. No. 3,770,287—Weber
U.S. Pat. No. 4,147,312—Secor
U.S. Pat. No. 4,050,643—Secor The closest discovered are those to Stollenwork, U.S. Pat. No. 4,150,622 and Hoexter U.S. Pat. No. 3,378,902, and which are discussed in the specification.

BACKGROUND OF THE INVENTION

This invention relates to a printing roller, and more particularly to the type of roller which comprises a mandrel fitted with a removable cylinder.

In certain types of printing, a printing cylinder is employed, the purpose of which is to carry ink for printing operations. The ink is transferred from a cylindrical surface to the surface of the paper which runs between an impression roller and the printing cylinder. Printing rollers are used to support flexible printing plates, and the roller mandrels are designed to be rotatably mounted in a printing machine. The cylinder is normally removable from the mandrel to allow the printing plate to be changed without changing the entire roller.

One common method for changing such printing cylinders is utilized where the cylinders are attached to outer journals. In particular, the cylinder is slid over the journals, and through heat treatment processes, the cylinders are shrunk onto the journals at their ends, thereby forming a frictional fit between the rotating journals and printing cylinder carried thereon. In order to remove the cylinder, heat is applied to the journal-cylinder interface allowing expansion of the cylinder to permit the cylinder to be removed from the journal.

Various systems have been proposed to eliminate the heat treatment process for removing printing rollers from the journal or mandrel assembly. Hydraulic systems have been suggested, and one such system is identified in U.S. Pat. No. 3,378,902 issued Apr. 23, 1978 to Rolf Hoexter. A relatively complex and difficult system is set forth in which precise drilling is suggested for forming thin-walled pressure sections to carry a radial pressure outwardly attempting to fix the printing cylinder to the hub section mounted between two outer collets.

In another system, as set forth in U.S. Pat. No. 4,150,622 entitled Printing Roller issued on Apr. 24, 1979 to Joseph A. Stollenwerk, a hydraulic system employing air pressure is employed in which compressible rings are adapted to be forced outwardly to hold the outer printing cylinder.

An object of this invention is to provide an improved printing roller of the type in which the printing cylinder is removed from the mandrel assembly.

Another object of this invention is to provide such a removable cylinder construction, which is easy to utilize, susceptible of widescale use, and reliable in operation.

Yet another object of this invention is to provide such a printing roller construction in which the cylinder is securely maintained in position, with respect to the mandrel.

Yet another object of this invention is to provide such a printing cylinder construction which may be easy to fabricate, minimize precise drilling requirements, and be effective in operation.

Another object of this invention is to provide such a printing roller in which the cylinder is attached to the mandrel at the outer sections with a long central thin tubular section being provided as part of a three piece mandrel assembly.

Yet another object of this invention is to provide such a printing roller assembly in which the hydraulic system employed is a fluid hydraulic system, and further in which the hydraulic actuating piston assembly is integrally formed in the mandrel assembly.

Other objects, advantages and features of this invention will become more apparent from the following description.

SUMMARY OF THE INVENTION

In accordance with the principles of this invention, a printing roller with a removable cylinder is provided, with the printing roller comprising a three-piece mandrel assembly having outer journal members and a central cylindrical tube, each having a common axis of rotation. The outer journal members are formed with throughbores therein which are adapted as hydraulic fluid passageways, and a cylindrical sleeve is mounted on each journal to receive pressure radially exerted causing expansion of the cylinders. Each cylindrical sleeve is fixedly attached to the journal body to prevent rotation therebetween, and the outer hollow printing cylinder is slidably mounted onto the three piece mandrel assembly with the inner surface of the printing cylinder bearing against the outer surface of the cylindrical sleeves of the journals. A hydraulic fluid system is employed in which the only precision drilling is that between an outer circumferential annulus around the journals and a throughbores in the journal body. Hydraulic fluid is employed which enables substantially equal pressure to be achieved throughout the hydraulic fluid and an integrally formed piston member pressurizes the hydraulic fluid causing expansion of the cylindrical sleeve against the printing cylinder. The metal to metal frictional engagement between the cylindrical sleeves at the outer journal sections and the printing cylinder enables a secure frictional engagement to be reached, in which the printing cylinder is fixedly held to the mandrel assembly while it rotates.

The three piece mandrel assembly enables separate hydraulic systems to be employed for connecting the printing cylinder to the mandrel in the outer portions, and pins are provided to further minimize the possibility of slippage in the printing roller assembly.

BRIEF DESCRIPTION OF THE DRAWINGS

FIG. 2 is an end view along the lines 2—2 showing the actuating screw and piston assembly.

FIG. 3 is an end view along the lines 3—3 of FIG. 1 showing the sleeve and journal connection.

FIG. 4 is an end view taken along the lines 4—4 of FIG. 1 showing the bleed hole or vent as part of the hydraulic system.

FIG. 5 is an end view through the journal along the lines 5—5 showing the sleeve and circumferential annulus and journal assembly.

DETAILED DESCRIPTION

Figure 1:
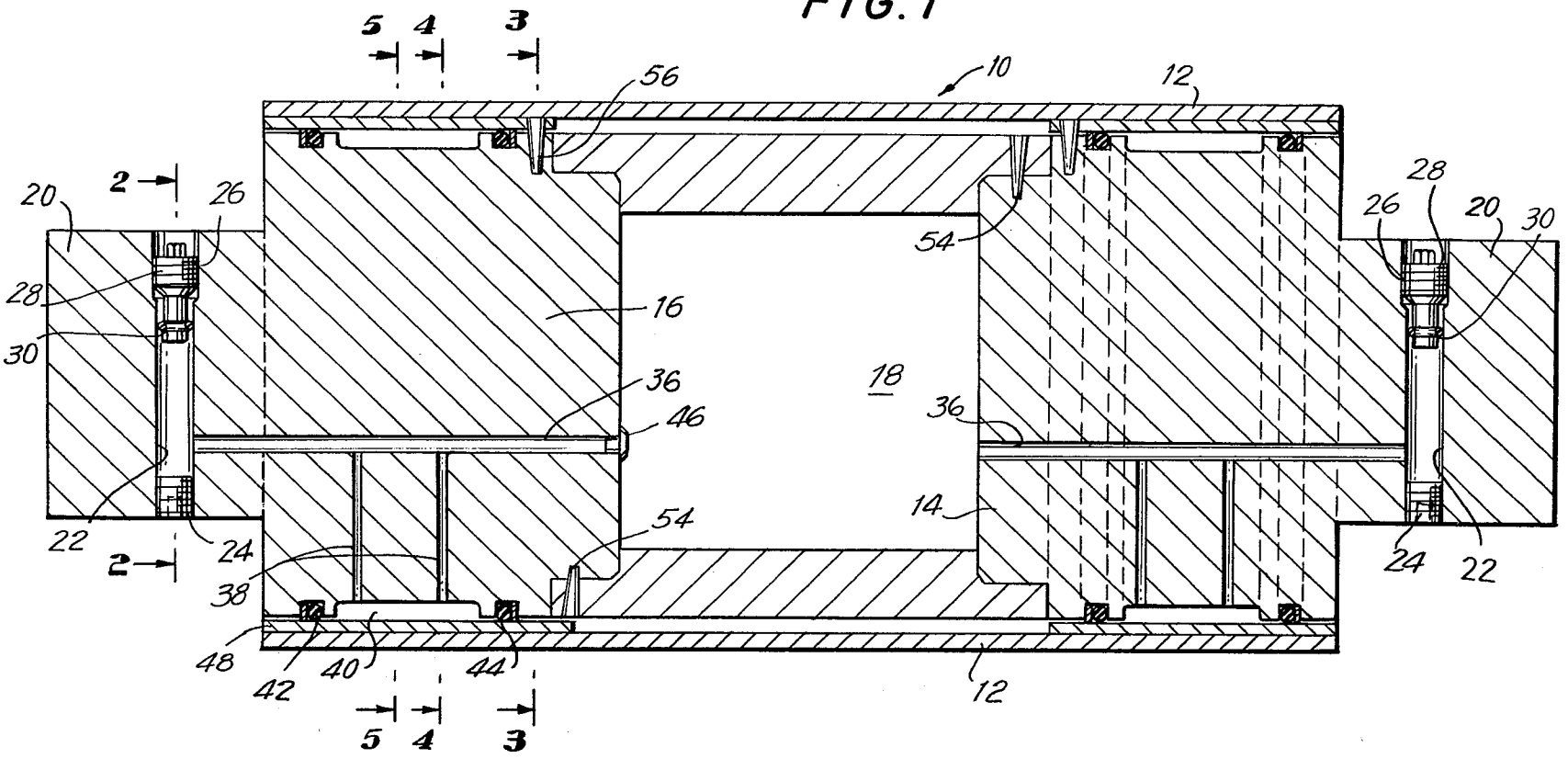
FIG. 1 is a longitudinal sectional view through a printing roller according to one embodiment of this invention.

FIG. 1 is a longitudinal sectional view of the printing roller with removable cylinder of this invention, generally designated with the numeral 10. The printing roller includes the removable cylinder 12 which is a hollow steel cylinder, adapted to slide over a three-piece mandrel formed of outer journal members 14 and 16 and a central hollow tubular section 18.

Each journal is identical to the other, and each comprises hydraulic fluid passageways for enabling the objects of this invention to be realized. In particular, each journal comprises an outer solid section 20 through which a throughbore 22 is drilled. One end of the throughbore is closed with a hydraulic plug 24 and the other end is threaded (FIG. 2) as at 26 to receive an actuator screw 28 having a piston and seal 30 integrally formed therewith, with the actuating screw being rotatable serving as a hydraulic actuator plunger means for pressurizing the fluid in the hydraulic system. A smaller bore 32 is provided in the solid outer section 20, which is adapted for filling the hydraulic system with fluid. A suitable plug 34 is adapted for closing bore 32.

A throughbore 36 which may be roughly drilled through journal 16 provides a fluid passageway from throughbore 22 to precision drilled passageways 38 formed in the journal. A circumferential annulus 40 is formed along the outer circumference of journal 16 and is sealed in the conventional manner by seals 42 and 44. A plug 46 closes one end of throughbore 36, while the other end in in fluid communication with actuating screw and piston 28.

A cylindrical sleeve 48 is slid onto journal 16 in the region of the circumferential annulus 40 and closes the hydraulic fluid system formed of passageways 22, 36, 38 and annulus 40 by cooperating with the seals 42 and 44, previously described. In this manner, a closed sealed hydraulic fluid system is provided with the actuating screw and piston integrally formed in the journal for increasing pressure within the hydraulic fluid carried in the passageways of the hydraulic system.

FIG. 4 illustrates passageway 36 which is adapted to receive fluid when filling the hydraulic fluid system.

In order to ensure that central tubular section 18 does not rotate with respect to journal 16, pins 54 are employed (FIG. 1) to fixedly connect the center tube section 18 with journals 16 and 14, respectively. In order to further ensure that sleeve 48 does not rotate with respect to journals 16 and 14, tapered pins 56 are radially spaced around the journal (see FIG. 3) at approximately 120° spacing to prevent the sleeve from turning on the journal.

In operation, the printing cylinder to be mounted on the three-piece mandrel assembly is, preferably, formed of a hollow thin tubular section, which is easy to carry, lightweight and simple to handle. The printing cylinder 12 is merely slid onto the three-piece mandrel assembly, and the inner surface of the printing cylinder 12 is in contact with sleeves 48 at each of the outer journal locations 14 and 16. Once the printing cylinder is in place, the actuating screw and piston is merely turned to increase the pressure in the hydraulic system, and the circumferential annulus receives such pressure, which is equally distributed through the hydraulic fluid medium, causing outward pressure to bear against sleeve 48 which then frictionally engages printing cylinder 12. In this manner, the printing cylinder is fixedly secured to the three-piece rotatable mandrel assembly with the surface of contact between the sleeve 48 and printing cylinder 12 being significant and widespread to enhance the frictional engagement between these members to prevent slippage during the printing operation.

When it is desired to change the printing cylinder 12, the actuating screw and piston is merely released, to reduce the fluid pressure in the hydraulic fluid, thereby releasing the frictional engagement between sleeve 48 and printing cylinder 12. Then one printing cylinder is removed from the mandrel assembly and another is put in place.

While the principles of this invention have been described above in connection with the specific embodiment, it is to be understood that this description is merely by way of example and not as a limitation as to the scope of the invention.

What is claimed is:

1. A printing roller assembly including a tubular printing cylinder and a mandrel on which said printing cylinder is removably supported, said mandrel including:

dual axially-spaced journal members, each having an outer cylindrical portion received within an end portion of the bore of said tubular printing cylinder;

a concentric cylindrical boss at one end of each said journal member;

a hollow, relatively light-weight cylindrical member having an outside diameter substantially the same as the outside diameter of each said cylindrical portion of each said journal member, and which is fixedly attached to said cylindrical end bosses of the respective journal members;

locating members extending radially through said cylindrical member at positions spaced circumferentially of each end thereof and secured within the associated bosses of said journal members;

said cylindrical member supporting said journal members in axial alignment with each other, and said locating members locating said bosses and said cylindrical member against rotational movement relatively to each other, the combined axial length of said cylindrical member and said bosses being substantially equal to the axial length of said printing cylinder;

said journal members each including dual, continuous, axially-spaced grooves in the outer periphery thereof and a continuous circumferential recess intermediate said grooves;

an imperforate radially-expandable metal sleeve loosely positioned on each journal member, each said sleeve having an axial length greater than the distance between the axially remote walls of said grooves in the associated journal member, each said sleeve having an internal diameter only slightly greater than the outer diameter of the associated journal member;

locating members extending radially through each said sleeve at positions spaced circumferentially thereof and secured in the associated journal member, said locating members inhibiting relative rotational and axial movement between each said sleeve and the associated journal member;

a sealing member located within each groove, each sealing member being held under compression by the associated sleeve and acting to center the associated sleeve on the associated journal member;

means positioned in each said groove and located between each said sealing member and the said remote wall of the associated groove adapted to inhibit axial extrusion of said sealing member under the influence of hydraulic fluid under pressure supplied to the circumferential recess intermediate said grooves;

said printing cylinder being positioned over said mandrel and overlying at least a portion of each said sleeve; and hydraulic pressure supply means incorporated into each said journal member are connected by internal conduits to the associated circumferential recess thereof, said supply means including a cylinder for hydraulic fluid, a piston closing the cylinder and movable into the cylinder, and means for moving said piston into said cylinder;

said hydraulic supply means being located within a member on at least one of said journal members and adapted for the support and driving of said mandrel and said printing cylinder carried thereby, said hydraulic pressure supply means being operative to exert pressure and to expand said sleeves into supporting and driving engagement with the inner periphery of said printing cylinder.

2. A printing roller assembly as claimed in claim 1, wherein said hydraulic pressure supply means is formed in said support member and comprises a through-bore sealed at one end and having a threaded section at the other end, an actuator screw cooperating with said threaded section to pressure hydraulic fluid in said system.

3. A printing roller as claimed in claim 1, wherein said locating members comprise pin means.

4. A printing roller as claimed in claim 3, wherein said pin means comprise three tapered pins each spaced 120° from the other around the circumference of the journal.

* * * * *